US007461719B2

(12) United States Patent
Tobik et al.

(10) Patent No.: US 7,461,719 B2
(45) Date of Patent: Dec. 9, 2008

(54) RESONATOR PERFORMANCE BY LOCAL REDUCTION OF COMPONENT THICKNESS

(75) Inventors: Steven E. Tobik, Winter Springs, FL (US); Stanley S. Sattinger, Pittsburgh, PA (US); Rajeev Ohri, Winter Springs, FL (US); Michael H. Koenig, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 389 days.

(21) Appl. No.: 11/272,357

(22) Filed: Nov. 10, 2005

(65) Prior Publication Data

US 2007/0102235 A1 May 10, 2007

(51) Int. Cl.
*F01N 1/02* (2006.01)

(52) U.S. Cl. ..... 181/213; 181/210; 181/211; 181/212; 181/214; 181/250; 181/273; 181/276; 181/293; 60/725; 60/772; 60/752; 60/748; 431/114; 415/119

(58) Field of Classification Search ..... 60/725, 60/772, 752, 748; 431/114; 415/119; 181/210, 181/211, 212, 213, 214, 250, 273, 276, 292, 181/293

See application file for complete search history.

(56) References Cited

U.S. PATENT DOCUMENTS

| | | | | |
|---|---|---|---|---|
| 3,819,009 | A | 6/1974 | Motsinger | |
| 4,199,936 | A * | 4/1980 | Cowan et al. | 60/226.1 |
| 4,944,362 | A | 7/1990 | Motsinger et al. | |
| 5,644,918 | A | 7/1997 | Gulati et al. | |
| 5,777,947 | A | 7/1998 | Ahuja | |
| 5,919,029 | A | 7/1999 | Van Nostrand et al. | |
| 6,009,705 | A | 1/2000 | Arnott et al. | |
| 6,182,787 | B1 | 2/2001 | Kraft et al. | |
| 6,257,366 | B1 | 7/2001 | Gerretsen et al. | |
| 6,351,947 | B1 | 3/2002 | Keller et al. | |
| 6,530,221 | B1 | 3/2003 | Sattinger et al. | |
| 6,601,672 | B2 | 8/2003 | Liu | |
| 6,837,050 | B2 * | 1/2005 | Mandai et al. | 60/725 |
| 2002/0079159 | A1 | 6/2002 | Liu | |
| 2003/0233831 | A1 * | 12/2003 | Suenaga et al. | 60/725 |
| 2005/0016178 | A1 | 1/2005 | Wasif et al. | |
| 2005/0034918 | A1 | 2/2005 | Bland et al. | |
| 2005/0097890 | A1 * | 5/2005 | Ikeda et al. | 60/748 |
| 2005/0166596 | A1 * | 8/2005 | Sattinger | 60/772 |
| 2005/0284690 | A1 * | 12/2005 | Proscia et al. | 181/214 |

FOREIGN PATENT DOCUMENTS

| | | | |
|---|---|---|---|
| EP | 1411225 | A1 | 4/2004 |
| JP | 2004183946 | A | 7/2004 |

* cited by examiner

*Primary Examiner*—Walter Benson
*Assistant Examiner*—Jeremy Luks

(57) ABSTRACT

Aspects of the invention are directed to a system for improving the damping performance of an acoustic resonator. According to aspects of the invention, a resonator, such as a Helmholtz resonator, can be attached to a surface of a combustor component in a turbine engine. The combustor component includes a region in which a plurality of passages extend through the thickness of the component. The resonator is attached to the component so as to enclose at least some of the passages. The passages are in fluid communication with a cavity defined between the component surface and the resonator. Resonator performance is a function of the length of the passages in the component. According to aspects of the invention, resonator performance can be improved by reducing the length of the passages in the component by reducing the thickness of the component in a region that includes the plurality of passages.

20 Claims, 3 Drawing Sheets

RESONATOR PERFORMANCE BY LOCAL REDUCTION OF COMPONENT THICKNESS

FIELD OF THE INVENTION

The invention relates in general to devices for suppressing acoustic energy and, more particularly, to the use of such devices in turbine engines.

BACKGROUND OF THE INVENTION

The use of acoustic damping devices, such as Helmholtz resonators, in turbine engines is known. For instance, various examples of resonators are disclosed in U.S. Pat. No. 6,530,221 and U.S. Patent Application Publication No. 2005/0034918. Resonators can be used to dampen undesired frequencies of dynamics that may develop in the combustor section of the engine during operation. Sufficient damping of combustion dynamics is critical to ensure reliable engine operation. Accordingly, one or more resonators can be attached to a surface of a turbine engine component.

While such resonators have proven to be effective, increased operational demands of turbine engines have necessitated the use of resonator systems with greater damping effectiveness. Thus, there is a need for a system that can improve resonator performance.

SUMMARY OF THE INVENTION

Aspects of the invention are directed to a resonator system. The system includes a component, which can be a turbine engine component, such as a combustor liner or a transition duct. The component has an outer peripheral surface and an inner peripheral surface. The component has a first region transitioning into a second region. The first region can be formed in the side of the component including the outer peripheral surface. The first region can extend continuously about the outer peripheral surface of the component.

The first region has a first thickness, and the second region has a second thickness that is greater than the first thickness. A first plurality of passages extends through the first thickness of the component in the first region.

The system further includes a resonator with a resonator plate and at least one side wall extending from and about the resonator plate. The resonator plate has an outside face and an inside face. The at least one side wall connects to the outer peripheral surface of the component so as to enclose at least some of the first plurality of passages. The at least some of the first plurality of passages that are enclosed by the resonator can have a substantially uniform cross-section.

A cavity is defined between the outer peripheral surface and the resonator. The first plurality of passages is in fluid communication with the cavity. Alternatively or in addition, a second plurality of passages extends through the resonator plate from the inside face to the outside face so as to be in fluid communication with the cavity.

The first thickness is substantially uniform in at least a portion of the first region enclosed by the resonator. In one embodiment, the first thickness can be substantially uniform throughout the entire first region. The first thickness can be from at least about 0.75 to about 1.5 millimeters and, more particularly, from about 1.2 millimeters to about 1.5 millimeters. In one embodiment, the first thickness can be from about 30 percent to about 90 percent of the thickness of the second thickness. More specifically, the first thickness can be from about 50 percent to about 60 percent of the thickness of the second thickness. The average thickness of the first region can be less than the average thickness of the second region.

DETAILED DESCRIPTION OF EMBODIMENTS OF THE INVENTION

Embodiments of the invention are directed to a system for improving the acoustic performance of a resonator. Aspects of the invention will be explained in connection with one resonator system, but the detailed description is intended only as exemplary. Embodiments of the invention are shown in FIGS. 1-3, but the present invention is not limited to the illustrated structure or application.

Figure 1:
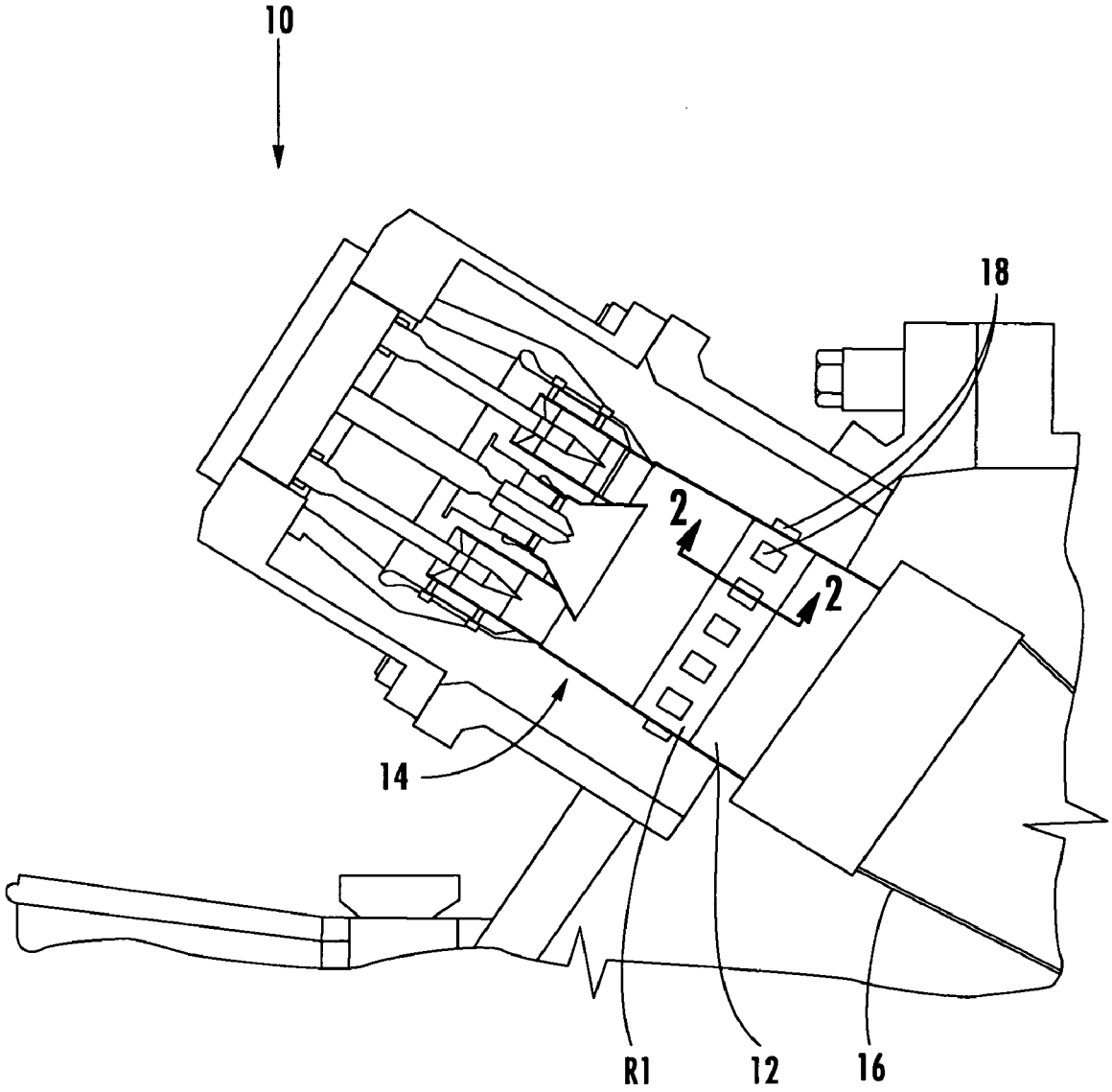
FIG. 1 is a view of a portion of the combustor section of a turbine engine, showing a plurality of resonators disposed about the periphery of a combustor component in a region of reduced thickness according to aspects of the invention.

FIG. 1 shows an example of a portion of the combustor section 10 of a turbine engine. It should be noted that aspects of the invention are not intended to be limited to any particular type of combustor, turbine engine or application in which turbine engines are used. As shown, one or more damping devices can be operatively connected to an outer peripheral surface 12 of a combustor component, which can be, for example, a liner 14 or a transition duct 16. One commonly used damping device is a resonator 18, such as a Helmholtz resonator. The resonators can be disposed in a first region R1 of the component.

The resonator 18 can have any of a number of configurations. For instance, aspects of the invention can be used in combination with any of the resonators disclosed in U.S. Pat. No. 6,530,221 and U.S. Patent Application Publication No. 2005/0034918, which are incorporated herein by reference. To facilitate discussion, the following description will be directed to the resonator shown in FIG. 2. However, it will be understood that aspects of the invention are not limited to the configuration shown, which is provided merely as an example.

Figure 2:
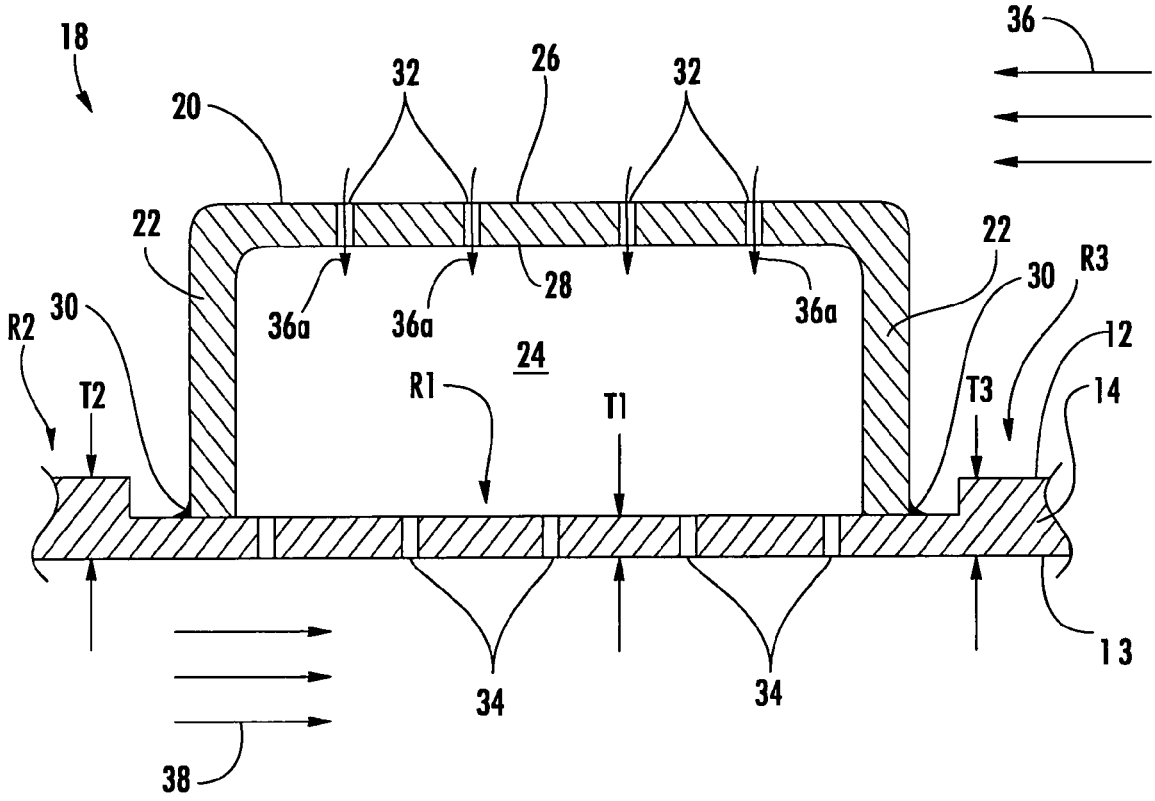
FIG. 2 is a cross-sectional view of a resonator on the combustor component according to aspects of the invention, viewed from line 2-2 in FIG. 1, showing the resonator attached to the combustor component in the region of reduced thickness.
Figure 3:
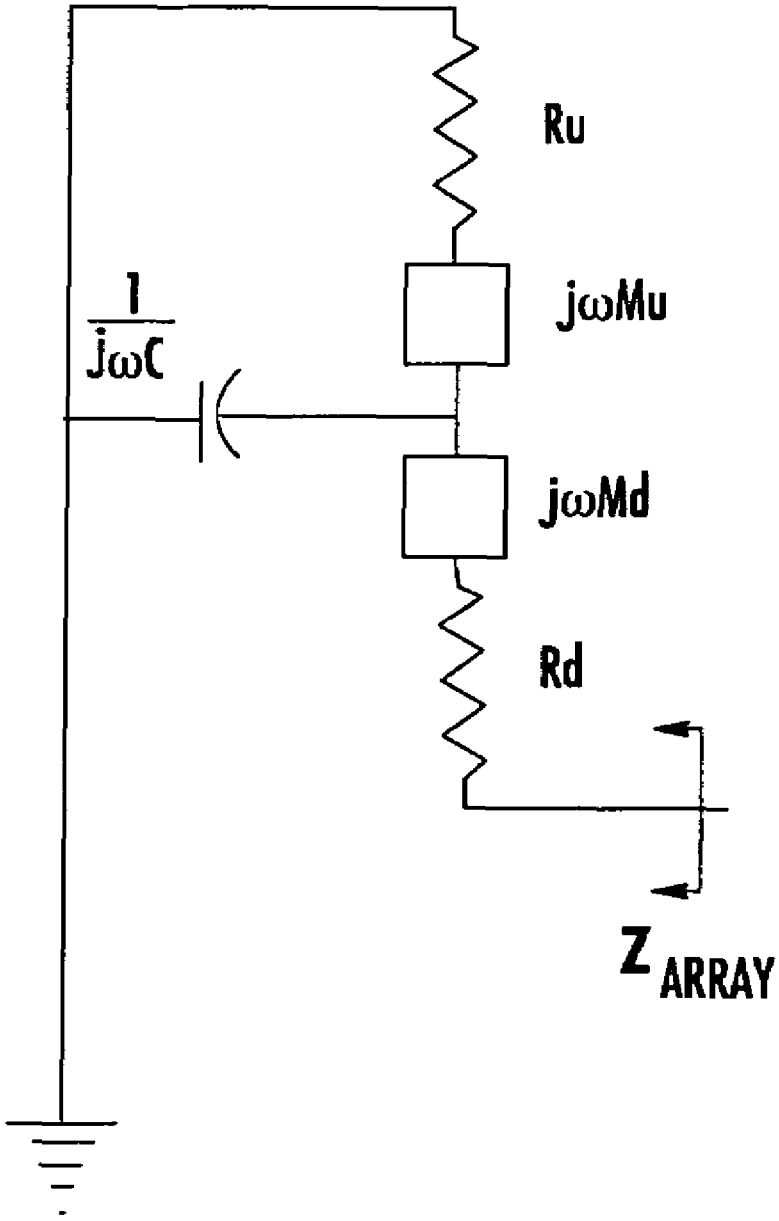
FIG. 3 is a graphical representation of an analytical model of damping performance of a flow-through resonator system according to aspects of the invention.

Referring to FIG. 2, the resonator 18 can include a resonator plate 20 and at least one side wall 22 extending from and about the resonator plate 20. A cavity 24 can be defined at least in part by the resonator plate 20, the at least one side wall 22 and the outer peripheral surface 12 of the combustor component. The resonator plate 20 can be substantially rectangular, but other geometries are possible. The resonator plate 20 can be substantially flat, or it can be curved. In one embodiment, the resonator plate 20 can be substantially parallel to the outer peripheral surface 12, but, in other embodiments, the resonator plate 20 may be non-parallel to the outer peripheral surface 12. The resonator plate 20 can have an outside face 26 and an inside face 28; the terms "outside" and "inside" are intended to indicate their position in relation to the outer peripheral surface 12 of the combustor component.

The side wall 22 can be provided in any of a number of ways. In one embodiment, the resonator plate 20 and the side wall 22 can be formed as a unitary structure, such as by casting or stamping. Alternatively, the side wall 22 can be made of one or more separate pieces, which can be attached to the resonator plate 20. For example, when the resonator plate 20 is rectangular, there can be four side walls 22, where one side wall 22 extends from each side of the resonator plate 20. In such case, the side walls 22 can be attached to each other where two side walls 22 abut.

The side wall 22 can also be attached to the resonator plate 20 in various places. In one embodiment, the side wall 22 can be attached to the outer periphery of the resonator plate 20. Alternatively, the side wall 22 can be attached to the inside face 28 of the resonator plate 20. Such attachment can be achieved by, for example, welding, brazing or mechanical engagement. The side wall 22 can be substantially perpendicular to the resonator plate 20. Alternatively, the side wall 22 can be non-perpendicular to the resonator plate 20.

In one resonator configuration, sometimes referred to as a "flow-through" type resonator, a plurality of passages 32 can extend through the resonator plate 20 from the outside face 26 to the inside face 28. While particularly suited for flow-through type resonators, aspects of the invention can be used in combination with almost any type of resonator including, for example, "blind-cavity" resonators in which the resonator plate 20 does not include any passages extending therethrough.

For convenience, the following discussion will be directed to a flow-through type resonator; however, it will be understood that such discussion id not intended to limit the scope of the invention. As mentioned above, the resonator plate 20 can have a plurality of passages 32 extending therethrough from the outside face 26 to the inside face 28. The passages 32 are in fluid communication with the cavity 24. The passages 32 can have any cross-sectional shape and size. For instance, the passages 32 can be circular, oval, rectangular, triangular, or polygonal. Ideally, each of the passages 32 has a substantially constant cross-section. The passages 32 can be substantially identical to each other. The passages 32 can be arranged on the resonator plate 20 in various ways. For example, in one embodiment, the passages 32 can be arranged in rows and columns.

The resonator 18 can be attached to the outer peripheral surface 12 of the combustor component in various ways, such as by welds 30 or by brazing. The outer peripheral surface 12 can be substantially flat, or it can be curved or otherwise non-flat. The combustor component can also have an inner peripheral surface 13. A plurality of passages 34 can extend through the combustor component from the inner peripheral surface 13 to the outer peripheral surface 12. The passages 34 are in fluid communication with the cavity 24.

There can be any quantity of passages 34 in the combustor component, and the passages 34 can be arranged in various ways. In one embodiment, the passages 32 in the resonator plate 20 can be arranged in X rows and Y columns, and the passages 34 in the combustor component can be arranged in X-1 rows and Y-1 columns. In this arrangement or in other arrangements, the passages 32 in the resonator plate 20 can be staggered or otherwise offset from the passages 34 in the combustor component. However, aspects of the invention are not limited to any particular arrangement. In a flow-through type resonator, the passages 32 in the resonator plate 20 can be referred to as the upstream passages, and the passages 34 in the combustor component can be referred to as the downstream passages, based on the flow path in the combustor section 10.

One or more resonators 18 can be attached to the outer peripheral surface 12 of the combustor component so as to enclose at least some of the passages 34 in the combustor component. The resonators 18 are particularly effective when disposed at or near the locations within the flow path of the combustor section that has the greatest acoustical pressure amplitudes and locations that are in fluid communication with the combustion zone. The locations having the greatest acoustical pressure amplitude can be established experimentally or analytically. In cases where a plurality of resonators 18 are attached to the combustor component, the resonators 18 can be arranged on and about the outer peripheral surface 12 of the combustor component in numerous ways, and aspects of the invention are not limited to any particular arrangement.

The acoustic damping performance of a resonator is a function of the length of the passages 34 in the combustor component, among other things. More specifically, the acoustic damping performance of a resonator is inversely related to the length of the downstream passages 34. Thus, the shorter the length of the downstream passages 34, the greater the damping performance of the resonator. According to aspects of the invention, the length of the downstream passages 34 can be decreased by reducing the thickness of the combustor component in a region containing the passages 34.

For instance, as shown in FIG. 2, the combustor component can include a first region R1 that transitions into regions R2 and R3 at ends of the first region R1. Region R2 can be axially upstream of the first region R1; region R3 can be axially downstream of the first region R1. The first region R1 can have an associated thickness T1. Each of the neighboring regions R2 and R3 can also have associated thickness T2 and T3, respectively. The thickness T1 is less than each of the thicknesses T2 and T3 of the neighboring regions R2 and R3, respectively. For convenience, the following discussion will assume that thickness T2 is substantially equal to thickness T3, but aspects of the invention are not limited to such a relationship.

Preferably, all of the downstream passages 34 are provided in the first region R1. In one embodiment, the region R1 can extend continuously about the entire periphery of the combustor component. Alternatively, the region R1 can comprise a plurality of regions of reduced thickness collectively extending at intervals about the periphery of the combustor component. In such case, each individual region of reduced thickness can include a plurality of the downstream passages 34. Preferably, the downstream passages 34 have a substantially uniform cross-section through thickness T1 of the first region.

In one embodiment, the thickness T1 can be substantially uniform at least in an area between any neighboring pair of the downstream passages 34. In another embodiment, the thickness T1 can be substantially uniform throughout an area of the first region R1 that is enclosed by one of the resonators 18. In still another embodiment, the thickness T1 can be substantially uniform throughout the first region R1. The term substantially uniform includes perfectly uniform as well as slight variations thereof. For instance, the first region R1 can include a slight taper.

The thickness T1 of the region R1 is preferably as small as possible so long as the component can withstand, structurally and otherwise, the operational environment of the combustor section without degradation in strength. In one embodiment, the minimum thickness of the first region R1 can be from about 0.75 to about 1.5 millimeters thick. In another embodiment, the thickness T1 of the first region R1 can be from about 1.2 millimeters to about 1.5 millimeters thick.

As noted above, the thickness T1 of first region R1 may not be substantially constant. Likewise, the thicknesses T2, T3 of the neighboring regions R2, R3 may not be substantially constant. However, the average thickness of the first region R1 can be less than the average thickness associated with each of the neighboring regions R2, R3. In one embodiment, the thickness T1 at any point within the first region R1 can be less than the thickness T2 at any point in the neighboring region R2 and/or the thickness T3 at any point in the neighboring region R3. In one embodiment, the thicknesses T2, T3 of the neighboring regions R2, R3 can be about 2.5 millimeters, whereas the thickness T1 of the first region R1 can be as small as 1.3 millimeters. There can be almost any relative thickness between the thickness T1 of the first region R1 and the thicknesses T2 and T3 associated with neighboring regions R2 and R3, respectively. For example, the thickness T1 of the first region R1 can be from 30% to 90% of the thickness T2, T3 of at least one of the neighboring regions R2, R3. In one embodiment, the thickness T1 of the first region R1 can be about 50-60% of the thickness of at least one of the neighboring regions R2, R3.

The first region R1 can be formed in the combustor component in various ways. For instance, the first region R1 can be formed by machining, rolling and/or other processes that can locally reduce the thickness of the combustor component in the region R1. Alternatively, the first region R1 can be formed by welding a first component segment defining region R1 to second and third component segments that define the neighboring regions R2 and R3.

In one embodiment, the region R1 of reduced thickness can be formed in the side of the combustor component including the outer peripheral surface 12, as shown in FIG. 2. In another embodiment, the region R1 of reduced thickness can be formed in the side of the combustor component including the inner peripheral surface 13. In still another embodiment, the region R1 of reduced thickness can be formed by removing material from or creating a depression on both sides of the combustor component, one side including the outer peripheral surface 12 and the other side including the inner peripheral surface 13.

While the length of the downstream passages 34 can be reduced by counter-boring each individual passage 34, such a construction is not desirable because the process of counter-boring each of the downstream passages 34 can be time consuming and labor intensive. Aspects of the invention recognize that manufacturing efficiencies can be gained by providing the downstream passages 34 in a relatively larger area of the combustor component with a reduced thickness T1.

Having described a resonator system according to aspects of the invention, one manner in which such a system can be used will now be described. For purposes of this example, it will be assumed that the resonators 18 are attached to the outer peripheral surface 12 of the combustor liner 14. During engine operation, the combustor section receives compressed air 36 from the compressor section (not shown) of the engine. The air 36 passes over the outer peripheral surface 12 of the liner 14.

The compressed air 36 can be mixed with fuel (not shown) at various points in its path through the combustor section, and the air-fuel mixture can be ignited to form the combustion gases 38. The gases 38 can be routed from the combustor section to the turbine section through the liner 14 and the transition duct 16. Acoustic pressure waves in the gas path 38 can arrive at the downstream passages 34 and can be substantially dampened at the resonator 18. The operation of a resonator is well known and is described in more detail in U.S. Pat. No. 6,530,221 and U.S. Patent Application Publication No. 2005/0034918, which are incorporated by reference. Because the length of the downstream passages 34 have been shortened in accordance with aspects of the invention, a greater acoustic response can be achieved to thereby enhance the damping capability of the resonator 18.

A portion 36*a* of the compressed air 36 can enter the resonator 18 through the upstream passages 32 in the resonator plate 20. Thus, there can be a steady purging or scavenging flow of air through the resonator 18. Such airflow through the resonator 18 can allow for a broader frequency response bandwidth so that the accuracy and repeatability of frequency tuning are rendered much less critical than in a "blind-cavity" resonator. Further, the airflow can be used to cool the portion of the liner 14 enclosed by the resonator 18. Lastly, the air 36*a* can exit the resonator 18 through the passages 34 in the liner 14, and join the combustion gases 38 flowing through the liner 14.

The acoustic damping performance of a resonator 18 may be expressed in terms of acoustic conductance, which can be defined as the in-phase component of volume-velocity through the downstream passages 34, divided by the amplitude of the pressure oscillation at the downstream passages 34 on the inner peripheral surface 13 side of the combustor component. A higher value of acoustic conductance indicates better damping performance. As the conductance of the resonators increases, the quantity of resonators required to provide adequate damping is reduced. Fewer resonators can result in cost savings and less cooling air consumption. Alternatively, the quantity of resonators can remain unchanged, but overall increase in resonator performance can provide greater margins against the occurrence of combustion dynamics. Preferably, the resonator system according to aspects of the invention is adapted to minimize the impact on other engine operating parameters including, for example, emissions, pressure drop, and liner temperature.

The natural frequency and the conductance of a through-flow resonator are governed by the geometries of the upstream and downstream passages 32, 34, the volume of the cavity 24, and the steady pressure differentials across each of the upstream and downstream passages 32, 34. The dynamic response of a through-flow resonator can be analytically modeled as shown in FIG. 3. In a high-performance resonator, a much larger fraction of the total pressure drop across the resonator 18 occurs across the upstream passages 32 compared to the downstream passages 34, making the flow velocity and the acoustic resistance values of the upstream passages 32 larger than those of the downstream passages 34.

To optimize resonator performance in accordance with aspects of the invention, the acoustic inertance Md of the downstream passages 34 can be made as small as possible within the design and performance limits of the system. Minimizing the acoustic inertance Md of the downstream passages 34 can have the effect of maximizing the conductance of the resonator 18 because a comparatively larger volume of the cavity 24 (corresponding to a large compliance, C) will result from frequency tuning when the inertance Md of the downstream passages 34 is small. A large compliance, in turn, can isolate the flow oscillations from the high-resistant upstream flow path, making the conductance large.

As discussed above, the acoustic conductance of a resonator 18 can vary as a function of the local thickness of the component to which the resonator is attached. Generally, reductions in the thickness are can result in improved resonator performance. According to one analytical model, a 50 percent reduction in the length of the passages 34 in the combustor component can result in about a 50 percent increase in the normalized conductance of the resonators 18.

In addition to those systems described herein, it will be appreciated that the system according aspects of the invention can be used in connection with a variety of resonator designs including, for example, those disclosed in U.S. Pat. No. 6,530,221 and U.S. Patent Application Publication No. 2005/0034918, which are incorporated by reference. It should be noted that resonators according to aspects of the invention have been described herein in connection with the combustor section of a turbine engine, but it will be understood that the resonators can be used in any section of the engine that may be subjected to undesired acoustic energy. The resonator system according to aspects of the invention can have application beyond the context of turbine engines to improve the acoustic damping performance of any resonator. Thus, it will of course be understood that the invention is not limited to the specific details described herein, which are given by way of example only, and that various modifications and alterations are possible within the scope of the invention as defined in the following claims.

What is claimed is:

1. A resonator system comprising:

a component having an outer peripheral surface and an inner peripheral surface, the component having a first region transitioning into a second region, the first region having a first thickness and the second region having a second thickness that is greater than the first thickness, wherein the first region is defined by a depression formed in at least one of the outer peripheral surface and the inner peripheral surface of the component, wherein a first plurality of passages extend through the first thickness of the component in the first region; and a resonator including a resonator plate and at least one side wall extending from and about the resonator plate, at least one side wall connecting to the outer peripheral surface of the component so as to enclose at least some of the first plurality of passages, wherein the first thickness is substantially uniform in at least a portion of the first region enclosed by the resonator, wherein a cavity is defined between the outer peripheral surface and the resonator, the first plurality of passages being in fluid communication with the cavity.

2. The system of claim 1 wherein the first thickness is substantially uniform throughout the first region.

3. The system of claim 1 wherein the at least some of the first plurality of passages that are enclosed by the resonator have a substantially uniform cross-section.

4. The system of claim 1 wherein the component is a turbine engine component.

5. The system of claim 1 wherein the first thickness is at least about 0.75 to about 1.5 millimeters.

6. The system of claim 1 wherein the first thickness is from about 1.2 millimeters to about 1.5 millimeters.

7. The system of claim 1 wherein the first thickness is from about 30 percent to about 90 percent of the thickness of the second thickness.

8. The system of claim 1 wherein the first thickness is from about 50 percent to about 60 percent of the thickness of the second thickness.

9. The system of claim 1 wherein the average thickness of the first region is less than the average thickness of the second region.

10. The system of claim 1 wherein the first region is formed in the side of the component including the outer peripheral surface.

11. The system of claim 10 wherein the first region extends continuously about the outer peripheral surface of the component.

12. A resonator system comprising:

a component having an outer peripheral surface and an inner peripheral surface, the component having a first region transitioning into a second region, the first region having a first thickness and the second region having a second thickness that is greater than the first thickness, wherein the first region is defined by a depression formed in at least one of the outer peripheral surface and the inner peripheral surface of the component, wherein a first plurality of passages extend through the first thickness of the component in the first region; and a resonator including a resonator plate and at least one side wall extending from and about the resonator plate, at least one side wall connecting to the outer peripheral surface of the component so as to enclose at least some of the first plurality of passages, wherein the first thickness is substantially uniform in at least a portion of the first region enclosed by the resonator, wherein a cavity is defined between the outer peripheral surface and the resonator, the first plurality of passages being in fluid communication with the cavity, wherein the resonator plate has an outside face and an inside face, and further including a second plurality of passages extending through the resonator plate from the inside face to the outside face so as to be in fluid communication with the cavity.

13. The system of claim 12 wherein the first region is formed in only the side of the component including the outer peripheral surface.

14. The system of claim 12 wherein the first thickness is substantially uniform throughout the first region.

15. The system of claim 12 wherein the at least some of the first plurality of passages that are enclosed by the resonator have a substantially uniform cross-section.

16. The system of claim 12 wherein the first thickness is at least about 0.75 to about 1.5 millimeters.

17. The system of claim 12 wherein the first thickness is from about 1.2 millimeters to about 1.5 millimeters.

18. The system of claim 12 wherein the first thickness is from about 30 percent to about 90 percent of the thickness of the second thickness.

19. The system of claim 12 wherein the first thickness is from about 50 percent to about 60 percent of the thickness of the second thickness.

20. The system of claim 12 wherein the average thickness of the first region is less than the average thickness of the second region.

* * * * *